US012800177B2

(12) United States Patent
Kim et al.

(10) Patent No.: US 12,800,177 B2
(45) Date of Patent: Nov. 17, 2026

(54) INTEGRATED THERMAL MANAGEMENT SYSTEM

(71) Applicants: Hyundai Motor Company, Seoul (KR); Kia Corporation, Seoul (KR)

(72) Inventors: Ki Mok Kim, Busan (KR); Sang Shin Lee, Suwon-si (KR); Man Ju Oh, Yongin-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 253 days.

(21) Appl. No.: 18/301,590

(22) Filed: Apr. 17, 2023

(65) Prior Publication Data

US 2024/0191901 A1 Jun. 13, 2024

(30) Foreign Application Priority Data

Dec. 12, 2022 (KR) ..... 10-2022-0172853

(51) Int. Cl.
*F24F 11/83* (2018.01)
*F24F 11/00* (2018.01)

(52) U.S. Cl.
CPC ..... *F24F 11/83* (2018.01); *F24F 11/0008* (2013.01)

(58) Field of Classification Search
CPC ..... F24F 11/83; F24F 11/0008; F24F 11/32; F24F 11/36; B60H 2001/00928; B60H 2001/00949; B60H 2001/00935; B60H 2001/3266
See application file for complete search history.

(56) References Cited

U.S. PATENT DOCUMENTS

2015/0101353 A1* 4/2015 Oh ..... H01M 10/6568 62/3.2
2020/0362746 A1* 11/2020 Lee ..... B60H 1/3211
2021/0053412 A1* 2/2021 Kim ..... B60L 58/27
2021/0252942 A1* 8/2021 Jeong ..... B60H 1/3213
2022/0176773 A1* 6/2022 Lee ..... B60H 1/00885
2024/0140161 A1* 5/2024 Morris ..... B60H 1/00278

FOREIGN PATENT DOCUMENTS

KR 20140147365 A 12/2014

* cited by examiner

*Primary Examiner* — Jianying C Atkisson
*Assistant Examiner* — Meraj A Shaikh
(74) *Attorney, Agent, or Firm* — Slater Matsil, LLP

(57) ABSTRACT

An embodiment integrated thermal management system includes a refrigerant circuit including a compressor, a condenser, an expander, and an evaporator, a first coolant line including a first heat exchanger configured to exchange heat with the evaporator of the refrigerant circuit and an internal heat exchanger configured to adjust a temperature of air-conditioning air through heat exchange with a coolant, first and second switching valves respectively disposed at front and rear ends of the internal heat exchanger in the first coolant line, a second coolant line connected to the first and second switching valves and including a second heat exchanger configured to exchange heat with the condenser of the refrigerant circuit, a third coolant line branching off from the first coolant line and including a battery, and a fourth coolant line branching off from the first coolant line and including a PE component.

20 Claims, 12 Drawing Sheets

INTEGRATED THERMAL MANAGEMENT SYSTEM

CROSS-REFERENCE TO RELATED APPLICATIONS

This application claims the benefit of Korean Patent Application No. 10-2022-0172853, filed on Dec. 12, 2022, which application is hereby incorporated herein by reference.

TECHNICAL FIELD

The present invention relates to an integrated thermal management system.

BACKGROUND

Recently, environmentally friendly vehicles such as electric vehicles have come into wide use to solve environmental issues caused by internal combustion engine vehicles. In the case of the internal combustion engine vehicle in the related art, waste heat from an engine may be used to heat the interior, which does not require energy for a separate heating process. However, because the electric vehicle has no engine, i.e., a heat source, separate energy is required to perform the heating process, which causes a deterioration in fuel economy. Further, the deterioration in fuel economy decreases a travelable distance of the electric vehicle and causes the vehicle to be frequently charged, which causes discomfort.

Meanwhile, as the vehicle is motorized, there is an additional need to manage not only heat in the interior of the vehicle, but also heat of electrical components such as a high-voltage battery and a motor. That is, in the case of the electric vehicle, the interior space, the battery, and the electrical components have different needs for air conditioning, and thus there is required a technology capable of maximally saving energy by independently coping with and efficiently and cooperatively managing the different needs. Therefore, an integrated vehicle heat management concept has been proposed in order to improve thermal efficiency by independently managing heat of the respective components and integrating the heat management of the entire vehicle.

Meanwhile, a refrigerant circulation module, which conditions the air in an interior of an electric vehicle, circulates a refrigerant by using electrical energy. However, there is a problem in that the refrigerant circulation module in the related art consumes a large amount of electrical energy and increases a size of a package.

Therefore, there has been developed a technology for miniaturizing the refrigerant circulation module and adjusting a temperature of air-conditioning air by using a coolant through heat exchange between a refrigerant and the coolant. The technology is called a secondary-type air conditioning system, and the secondary-type air conditioning system cools the interior by using the coolant instead of the refrigerant during a process of cooling the interior. Therefore, there is a need for a solution to ensure cooling performance.

To this end, a cold core, which adjusts a temperature of air-conditioning air by using a coolant, needs to have a size 10% to 30% larger than a size of a cold core applied to the refrigerant circulation module in the related art. However, when the size of the cold core increases, there is a problem in that an overall size of the package increases, and it is difficult to ensure sufficient cooling efficiency.

The foregoing explained as the background is intended merely to aid in the understanding of the background of embodiments of the present invention, and is not intended to mean that embodiments of the present invention fall within the purview of the related art that is already known to those skilled in the art.

SUMMARY

The present invention relates to an integrated thermal management system. Particular embodiments relate to an integrated thermal management system capable of improving interior cooling performance and implementing a heat pump by miniaturizing a refrigerant circulation module and conditioning air in an interior through heat exchange between a refrigerant and a coolant.

Embodiments of the present invention can solve problems in the art and provide an integrated thermal management system capable of improving interior cooling performance and implementing a heat pump without increasing a size of a cold core by miniaturizing a refrigerant circulation module and conditioning air in an interior through heat exchange between a refrigerant and a coolant.

An embodiment of the present invention provides an integrated thermal management system including a refrigerant circuit including a compressor, a condenser, an expander, and an evaporator, a first coolant line including a first heat exchanger configured to exchange heat with the evaporator of the refrigerant circuit, and an internal heat exchanger configured to adjust a temperature of air-conditioning air through heat exchange with a coolant, first and second switching valves respectively disposed at front and rear ends of the internal heat exchanger in the first coolant line, a second coolant line connected to the first and second switching valves and including a second heat exchanger configured to exchange heat with the condenser of the refrigerant circuit, a third coolant line branching off from the first coolant line and including a battery, and a fourth coolant line branching off from the first coolant line and including a PE component.

The first coolant line may further include a branch tube disposed between the first heat exchanger and the first switching valve and a third switching valve disposed between the first heat exchanger and the second switching valve.

The second coolant line may further include a radiator and a fourth switching valve configured to allow the coolant to selectively flow to the radiator.

The third coolant line may be connected to the branch tube and the third switching valve, and the third coolant line may further include a first external heat exchanger, a fifth switching valve configured to allow the coolant to selectively flow to the first external heat exchanger, and a sixth switching valve selectively connected to the first switching valve at a front end of the battery.

The fourth coolant line may be connected between the branch tube, the first heat exchanger, and the third switching valve, and the fourth coolant line may further include a second external heat exchanger and a seventh switching valve configured to allow the coolant to selectively flow to the second external heat exchanger.

The first switching valve may be a four-way valve and have a port connected to the branch tube, a port connected to the front end of the internal heat exchanger of the first coolant line, a port connected to a rear end of the second heat exchanger of the second coolant line, and a port connected to the front end of the battery of the third coolant line.

The second switching valve may be a four-way valve and have a port connected to the third switching valve of the first coolant line, a port connected to the rear end of the internal heat exchanger of the first coolant line, a port connected to a front end of the second heat exchanger of the second coolant line, and a port connected to a rear end of the battery of the third coolant line.

The first coolant line may further include a first water pump and a coolant heater, the second coolant line may further include a second water pump, the third coolant line may further include a third water pump, and the fourth coolant line may further include a fourth water pump.

The integrated thermal management system may further include a controller configured to control the compressor, the respective switching valves, and the respective water pumps in accordance with an air conditioning mode and a thermal management mode.

At the time of cooling the PE component, the controller may operate the fourth water pump and control the respective switching valves so that the coolant flows to the PE component and the second external heat exchanger in the fourth coolant line.

At the time of cooling the battery, the controller may operate the third water pump and control the respective switching valves so that the coolant flows to the battery and the first external heat exchanger in the third coolant line.

At the time of cooling the battery, the controller may operate the compressor to circulate a refrigerant in the refrigerant circuit, and the controller may operate the first and second water pumps and control the respective switching valves so that the coolant flows to the first heat exchanger and the battery through the first coolant line and the third coolant line and the coolant flows to the second heat exchanger and the radiator in the second coolant line.

At the time of cooling an interior, the controller may operate the compressor to circulate a refrigerant in the refrigerant circuit, and the controller may operate the first and second water pumps and control the respective switching valves so that the coolant flows to the first heat exchanger and the internal heat exchanger in the first coolant line and the coolant flows to the second heat exchanger and the radiator in the second coolant line.

At the time of cooling the PE component during the process of cooling the interior, the controller may operate the fourth water pump and control the respective switching valves so that the coolant flows to the PE component and the second external heat exchanger in the fourth coolant line.

At the time of cooling the battery during the process of cooling the interior, the controller may operate the third water pump and control the respective switching valves so that the coolant flows to the battery and the first external heat exchanger in the third coolant line.

At the time of cooling the battery during the process of cooling the interior, the controller may control the respective switching valves so that the coolant flows to the first heat exchanger, the internal heat exchanger, and the battery through the first coolant line and the third coolant line, and the coolant flows to the second heat exchanger and the radiator in the second coolant line.

At the time of heating an interior, the controller may operate the compressor to circulate a refrigerant in the refrigerant circuit, and the controller may operate the first, second, and third water pumps and control the respective switching valves so that the coolant flows to the first heat exchanger and the first external heat exchanger through the first coolant line and the third coolant line and the coolant flows to the second heat exchanger and the internal heat exchanger through the first coolant line and the second coolant line.

At the time of absorbing heat from the PE component during a process of heating an interior, the controller may operate the compressor to circulate a refrigerant in the refrigerant circuit, and the controller may operate the second and fourth water pumps and control the respective switching valves so that the coolant flows to the first heat exchanger and the PE component through the first coolant line and the fourth coolant line and the coolant flows to the second heat exchanger and the internal heat exchanger through the first coolant line and the second coolant line.

At the time of absorbing heat from the battery during a process of heating an interior, the controller may operate the compressor to circulate a refrigerant in the refrigerant circuit, and the controller may operate the first and second water pumps and control the respective switching valves so that the coolant flows to the first heat exchanger and the battery through the first coolant line and the third coolant line and the coolant flows to the second heat exchanger and the internal heat exchanger through the first coolant line and the second coolant line.

At the time of raising a temperature of the battery, the controller may operate the second water pump and control the respective switching valves so that the coolant flows to the internal heat exchanger, the second heat exchanger, and the battery through the first coolant line, the second coolant line, and the third coolant line and the coolant heater operates.

The integrated thermal management system may further include a positive temperature coefficient (PTC) configured to adjust a temperature of the air-conditioning air together with the internal heat exchanger, in which at the time of performing dehumidification during a process of heating an interior, the controller operates the compressor to circulate a refrigerant in the refrigerant circuit, and the controller operates the first water pump and controls the respective switching valves so that the coolant flows to the first heat exchanger and the internal heat exchanger in the first coolant line and the PTC operates.

At the time of cooling or heating an interior, the controller may adjust the amount of operation of the compressor or each of the water pumps on the basis of a temperature of the air-conditioning air or a temperature of the interior.

According to the integrated thermal management system structured as described above, the refrigerant circulation module is miniaturized, such that the performance in cooling the interior is improved without increasing the size of the cold core at the time of conditioning air in the interior through the heat exchange between the refrigerant and the coolant.

That is, the cold coolant, which has exchanged heat with the evaporator of the refrigerant circuit, or the hot coolant, which has exchanged heat with the condenser of the refrigerant circuit, selectively flows to the internal heat exchanger for cooling the interior, which makes it possible to adjust the temperature of the air-conditioning air and simplify the structure because the temperature of the air-conditioning air may be adjusted only by the single internal heat exchanger.

In addition, the temperatures of the battery and the PE component may be managed, and the heat pump may be implemented, thereby ensuring energy efficiency.

DETAILED DESCRIPTION OF ILLUSTRATIVE EMBODIMENTS

Figure 1:
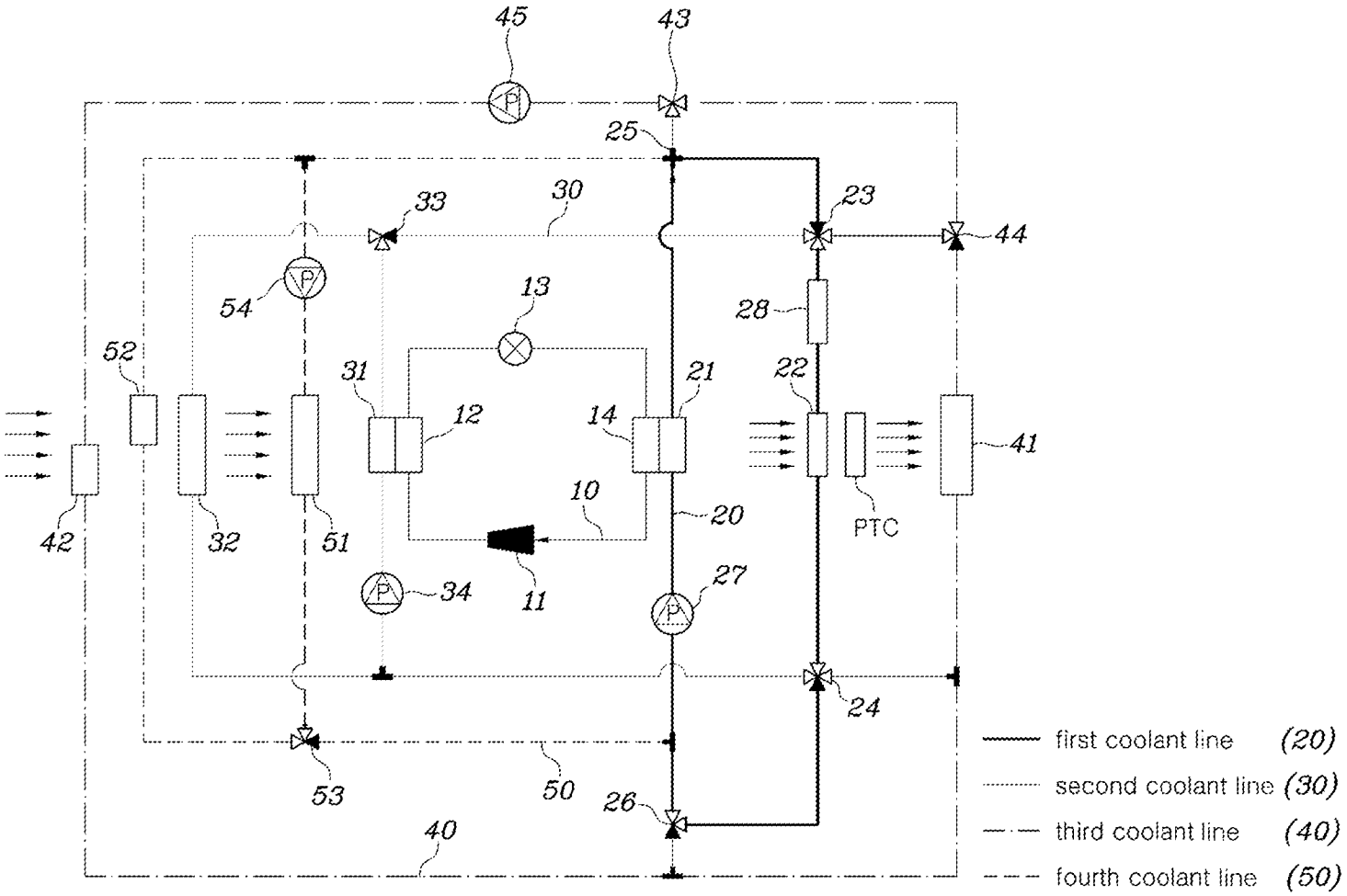
FIG. 1 is a view illustrating an integrated thermal management system according to an embodiment of the present invention.

Hereinafter, embodiments disclosed in the present specification will be described in detail with reference to the accompanying drawings. The same or similar constituent elements are assigned with the same reference numerals, and the repetitive description thereof will be omitted.

The suffixes "module," "unit," "part," and "portion" used to describe constituent elements in the following description are used together or interchangeably in order to facilitate the description, but the suffixes themselves do not have distinguishable meanings or functions.

In the description of the embodiments disclosed in the present specification, the specific descriptions of publicly known related technologies will be omitted when it is determined that the specific descriptions may obscure the subject matter of the embodiments disclosed in the present specification. In addition, it should be interpreted that the accompanying drawings are provided only to allow those skilled in the art to easily understand the embodiments disclosed in the present specification, and the technical spirit disclosed in the present specification is not limited by the accompanying drawings, and includes all alterations, equivalents, and alternatives that are included in the spirit and the technical scope of the present invention.

The terms including ordinal numbers such as "first," "second," and the like may be used to describe various constituent elements, but the constituent elements are not limited by the terms. These terms are used only to distinguish one constituent element from another constituent element.

When one constituent element is described as being "coupled" or "connected" to another constituent element, it should be understood that one constituent element can be coupled or connected directly to another constituent element, and an intervening constituent element can also be present between the constituent elements. When one constituent element is described as being "coupled directly to" or "connected directly to" another constituent element, it should be understood that no intervening constituent element is present between the constituent elements.

Singular expressions include plural expressions unless clearly described as different meanings in the context.

In the present specification, it should be understood the terms "comprises," "comprising," "includes," "including," "containing," "has," "having" or other variations thereof are inclusive and therefore specify the presence of stated features, integers, steps, operations, elements, components, or combinations thereof, but do not preclude the presence or addition of one or more other features, integers, steps, operations, elements, components, or combinations thereof.

A controller may include a communication device configured to communicate with another control unit or a sensor to control a corresponding function, a memory configured to store an operating system, a logic instruction, and input/output information, and one or more processors configured to perform determination, computation, decision, or the like required to control the corresponding function.

Hereinafter, an integrated thermal management system according to exemplary embodiments of the present invention will be described with reference to the accompanying drawings.

Figure 2:
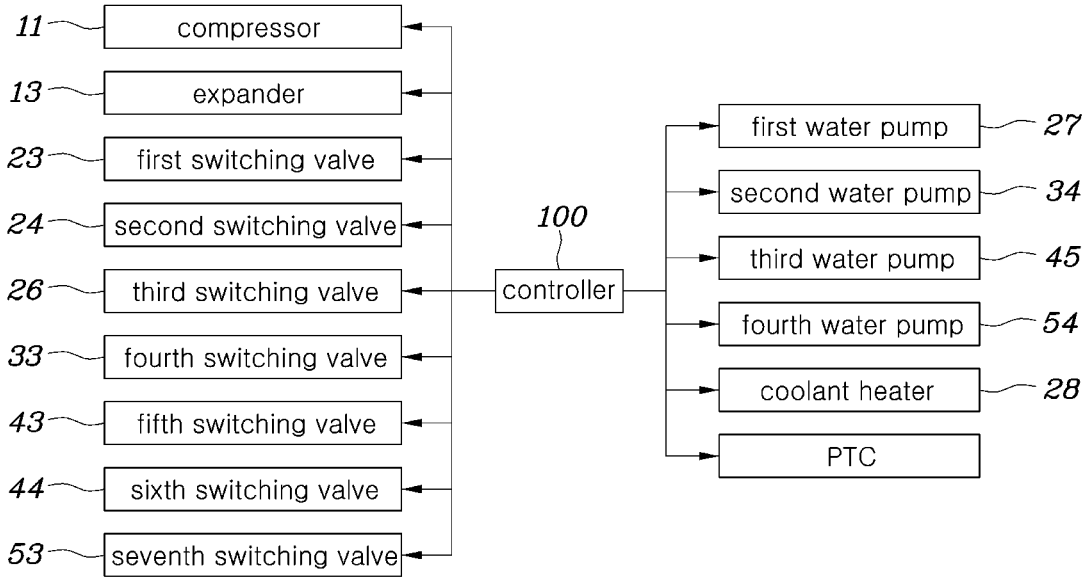
FIG. 2 is a configuration view of an integrated thermal management system according to an embodiment of the present invention.

FIG. 1 is a view illustrating an integrated thermal management system according to an embodiment of the present invention, and FIG. 2 is a configuration view of an integrated thermal management system according to an embodiment of the present invention.

Figure 3:
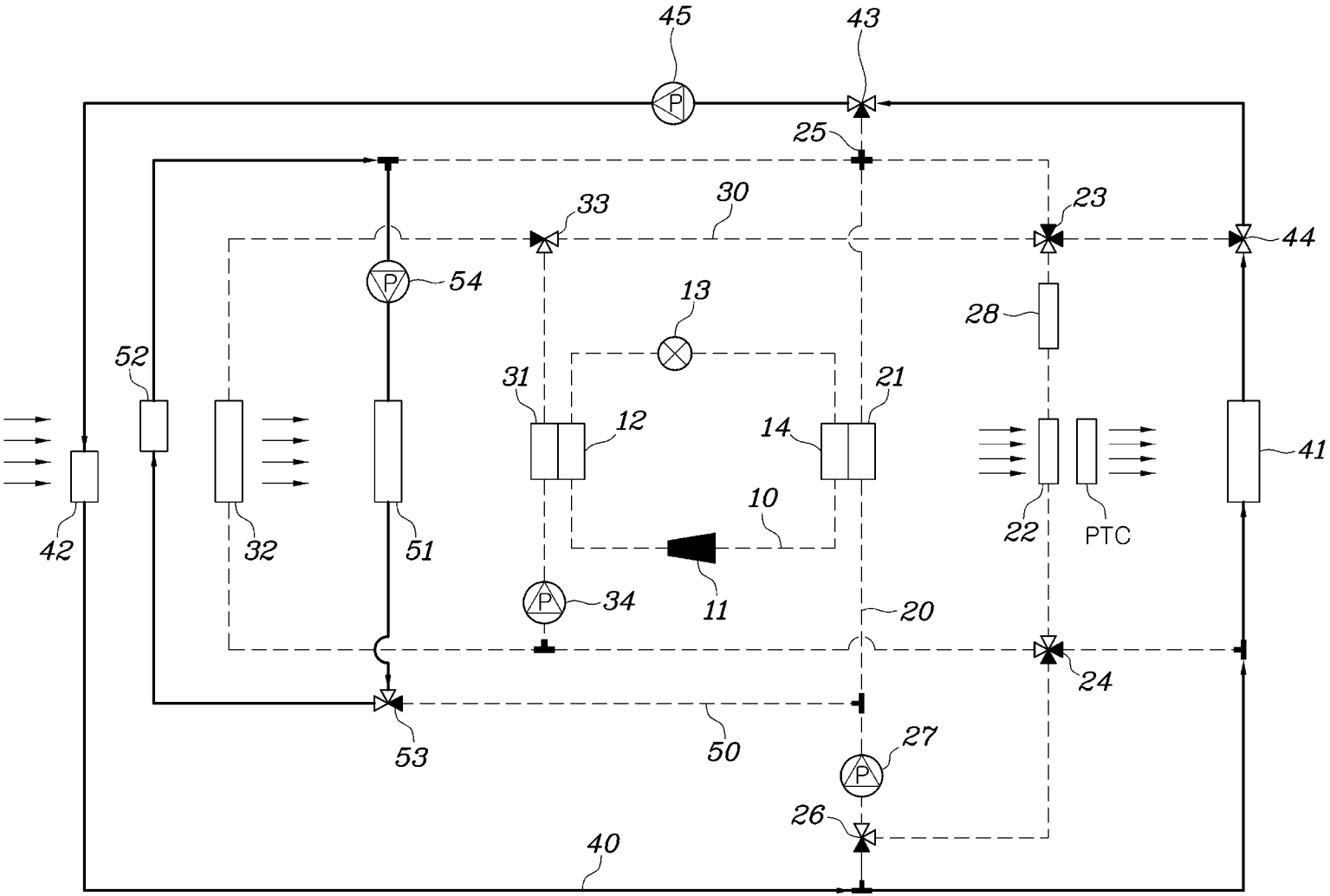
FIG. 3 is a view illustrating a process of cooling a PE component in the integrated thermal management system illustrated in FIG. 1.
Figure 4:
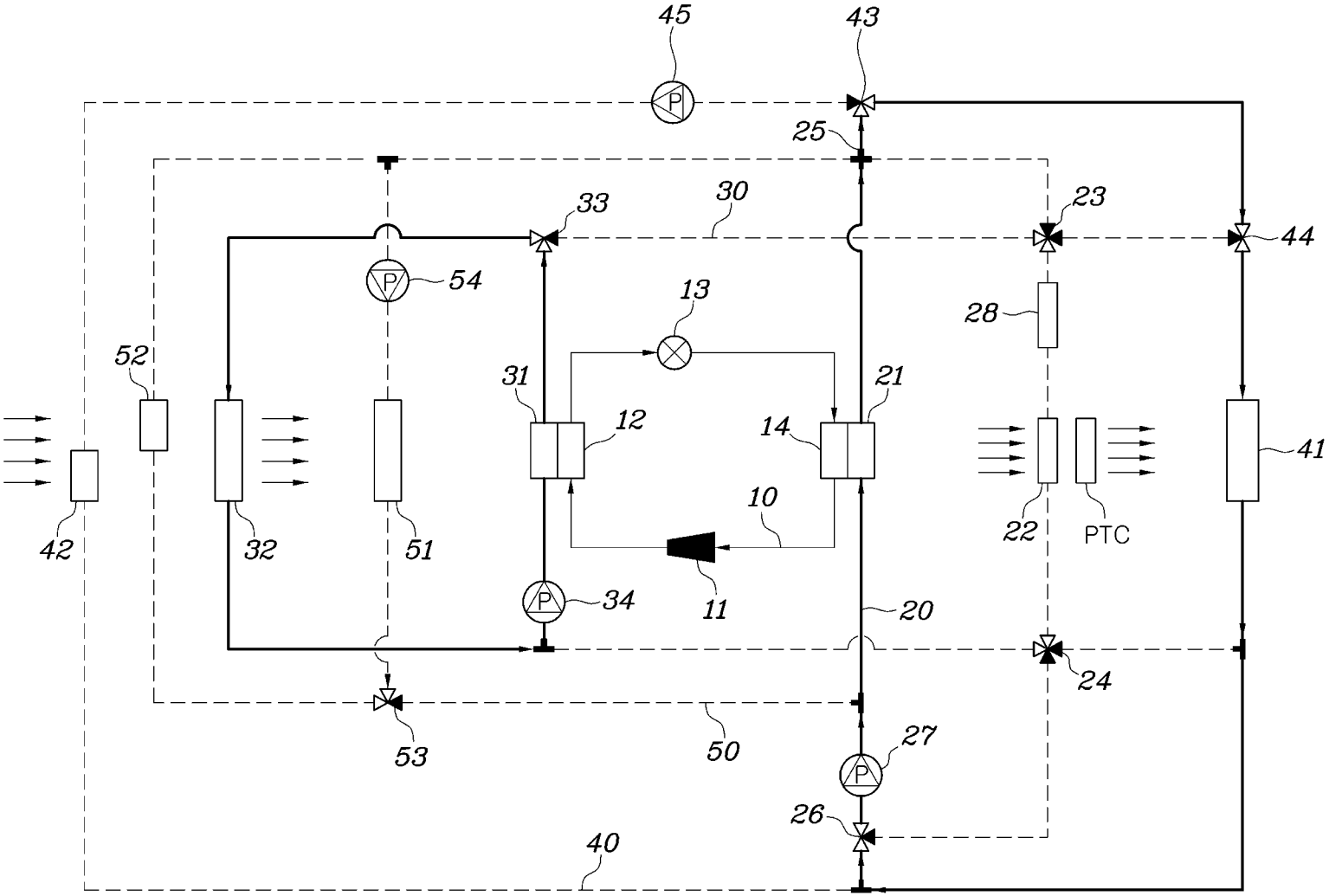
FIG. 4 is a view illustrating a process of cooling a battery in the integrated thermal management system illustrated in FIG. 1.
Figure 5:
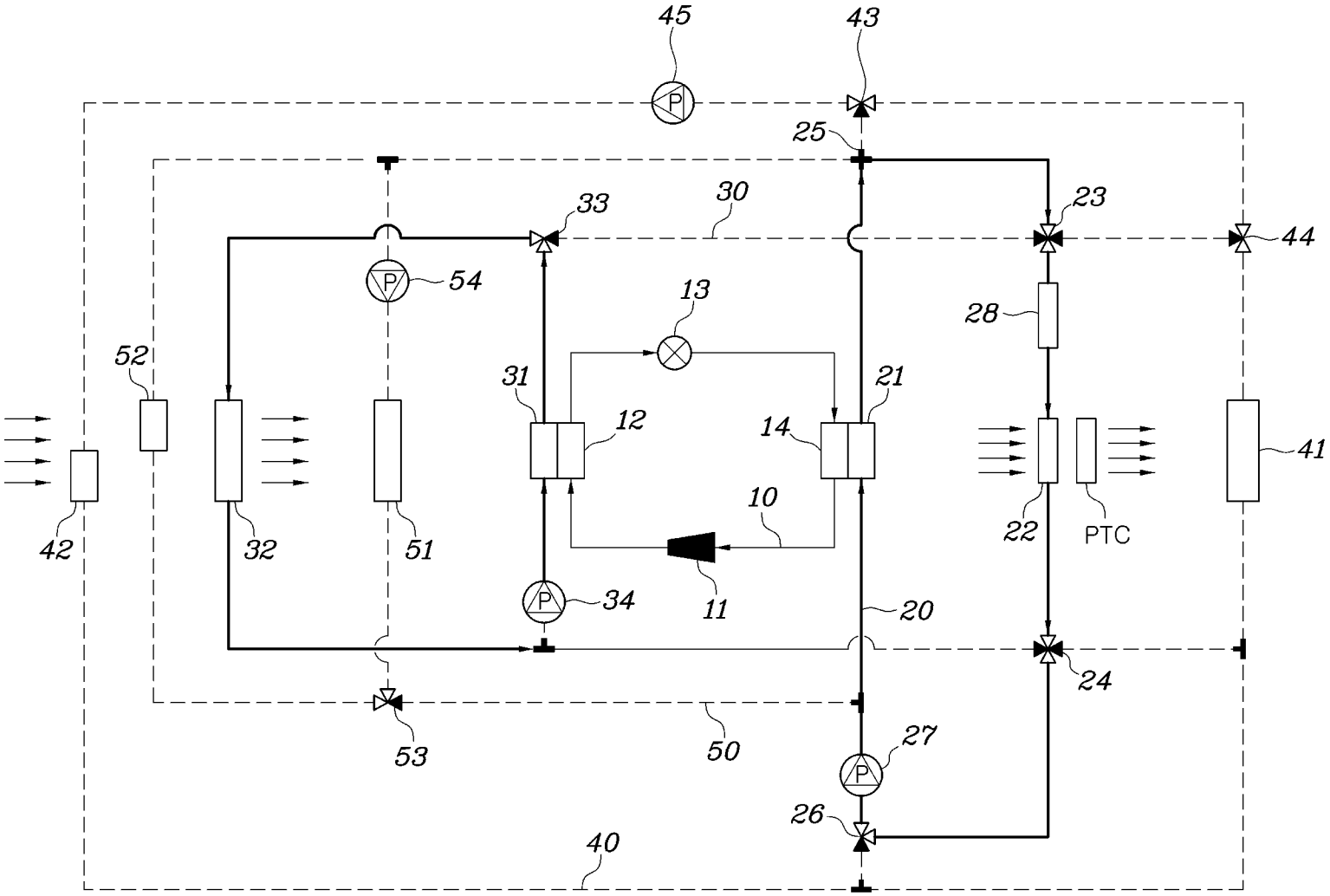
FIG. 5 is a view illustrating a process of cooling an interior in the integrated thermal management system illustrated in FIG. 1.
Figure 6:
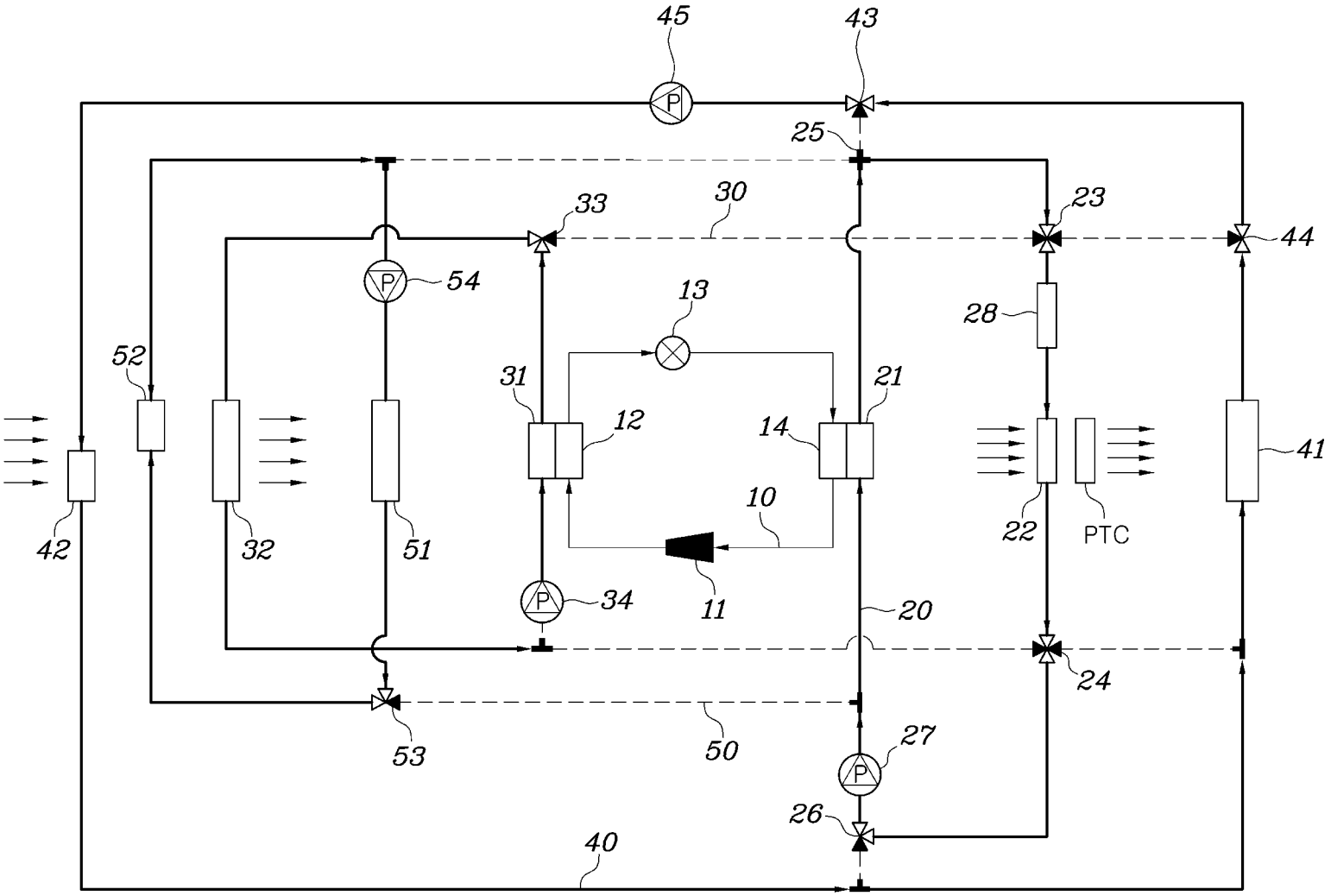
FIG. 6 is a view illustrating a process of cooling the PE component during the process of cooling the interior in the integrated thermal management system illustrated in FIG. 1.
Figure 7:
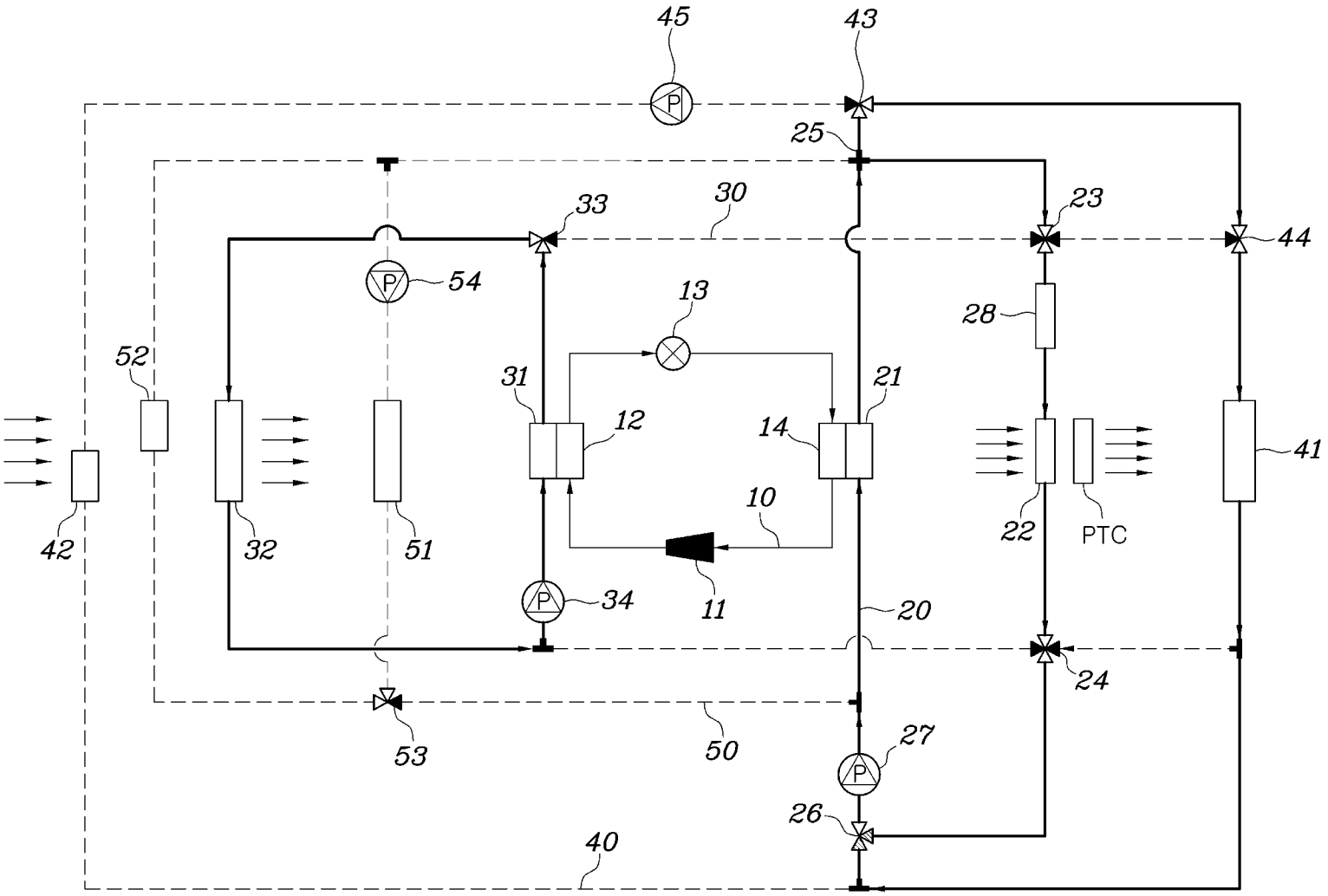
FIG. 7 is a view illustrating a process of cooling the battery during the process of cooling the interior in the integrated thermal management system illustrated in FIG. 1.
Figure 8:
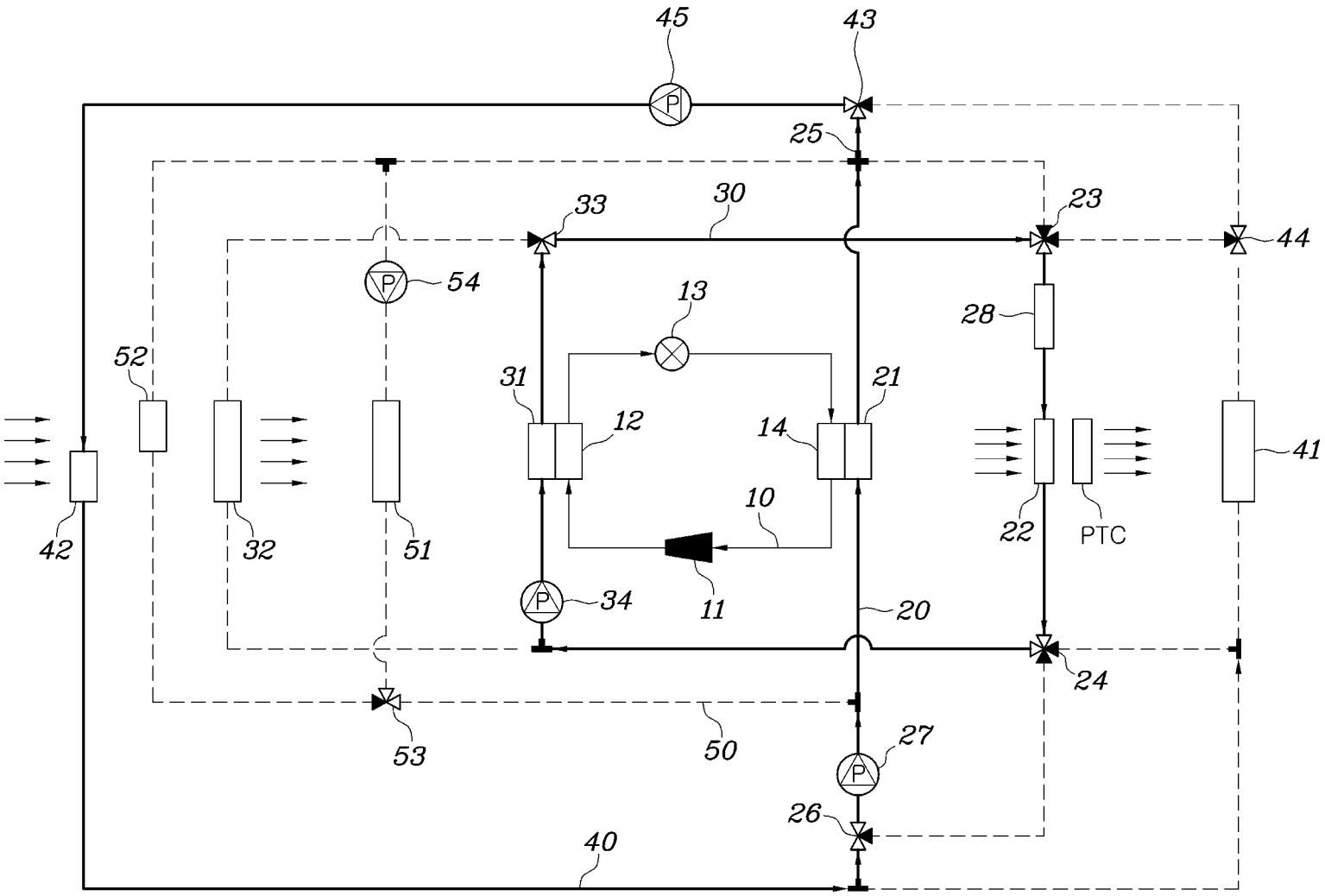
FIG. 8 is a view illustrating a process of heating the interior in the integrated thermal management system illustrated in FIG. 1.
Figure 9:
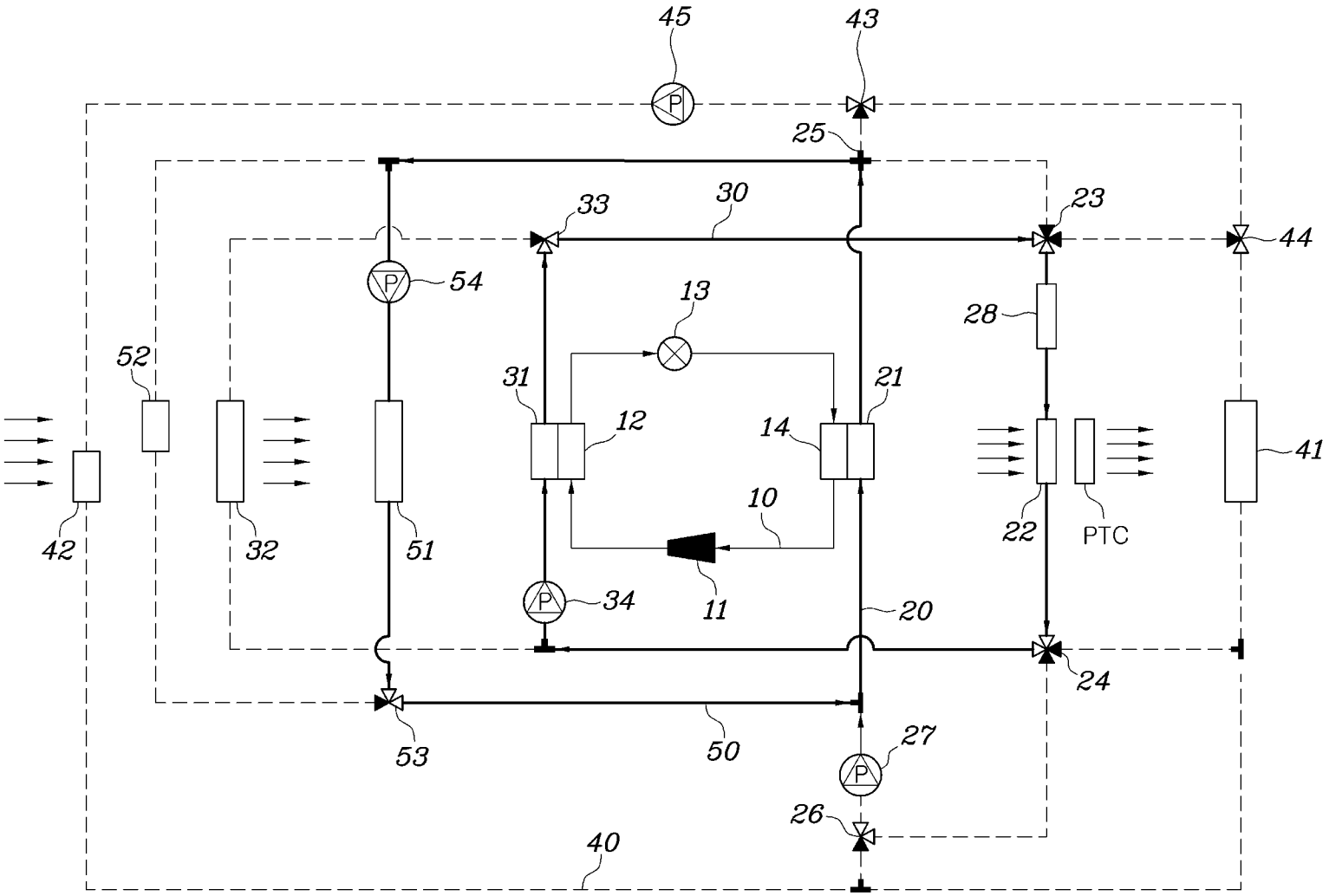
FIG. 9 is a view illustrating a process of absorbing heat from the PE component during the process of heating the interior in the integrated thermal management system illustrated in FIG. 1.
Figure 10:
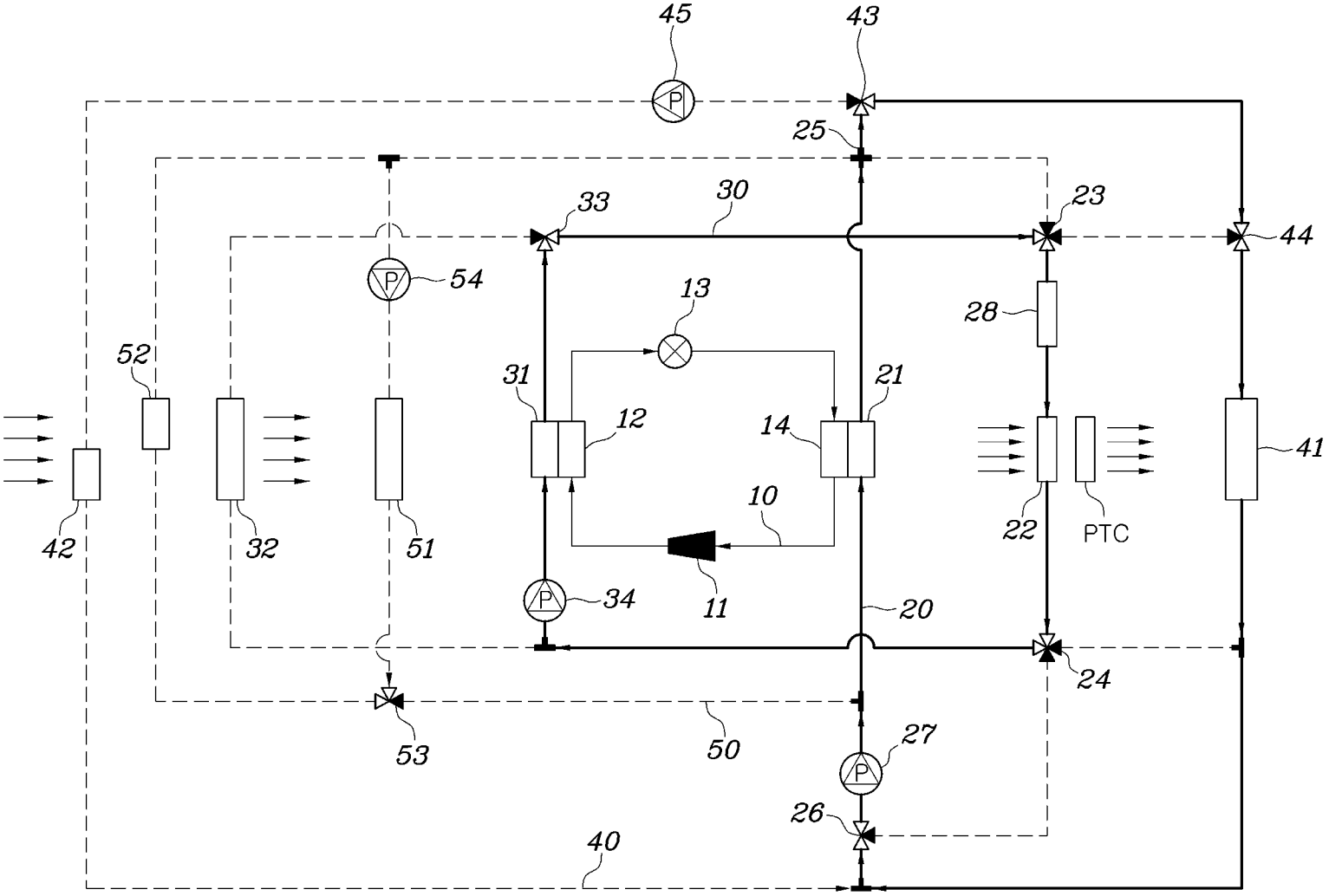
FIG. 10 is a view illustrating a process of absorbing heat from the battery during the process of heating the interior in the integrated thermal management system illustrated in FIG. 1.
Figure 11:
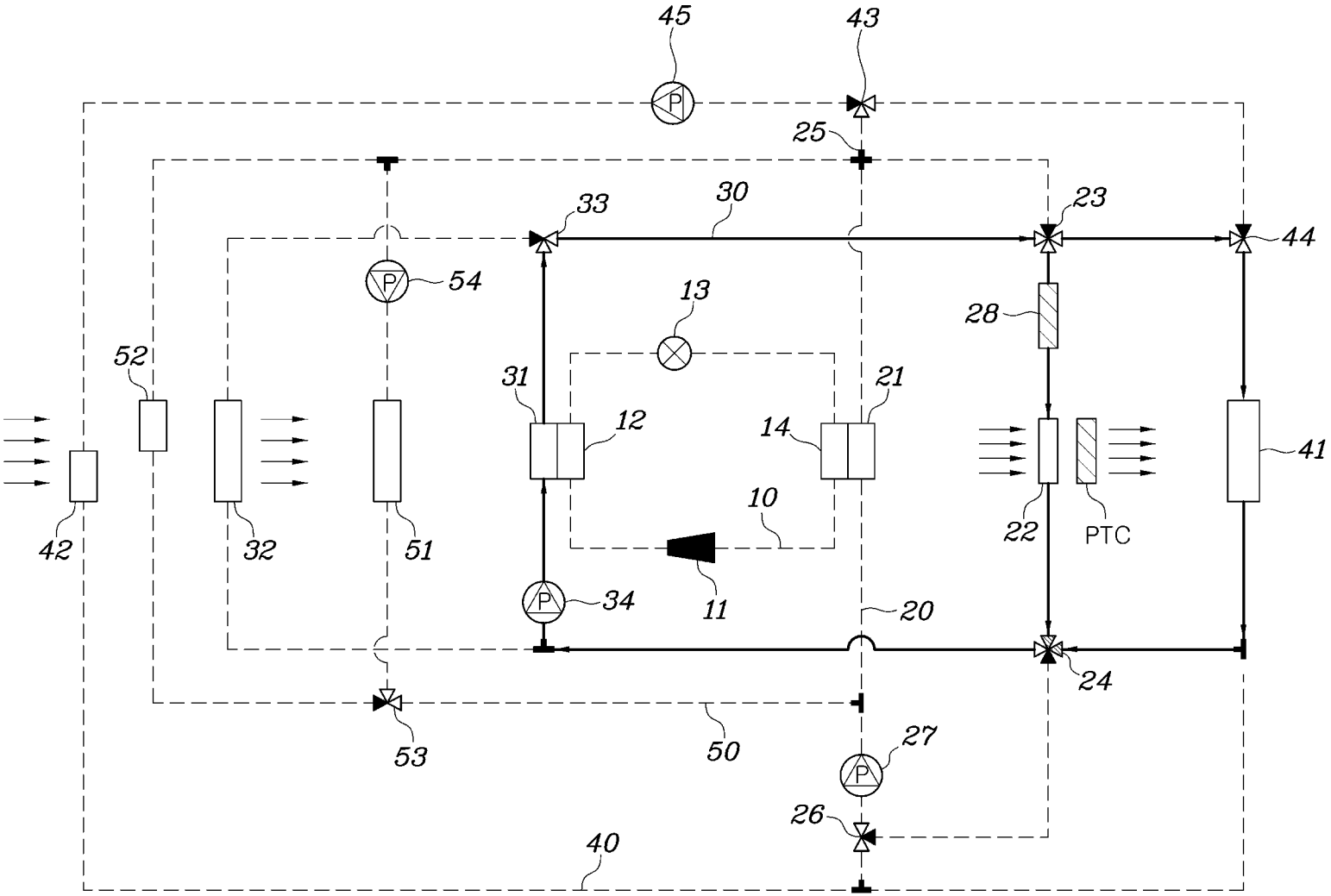
FIG. 11 is a view illustrating a process of raising a temperature of the battery in the integrated thermal management system illustrated in FIG. 1.
Figure 12:
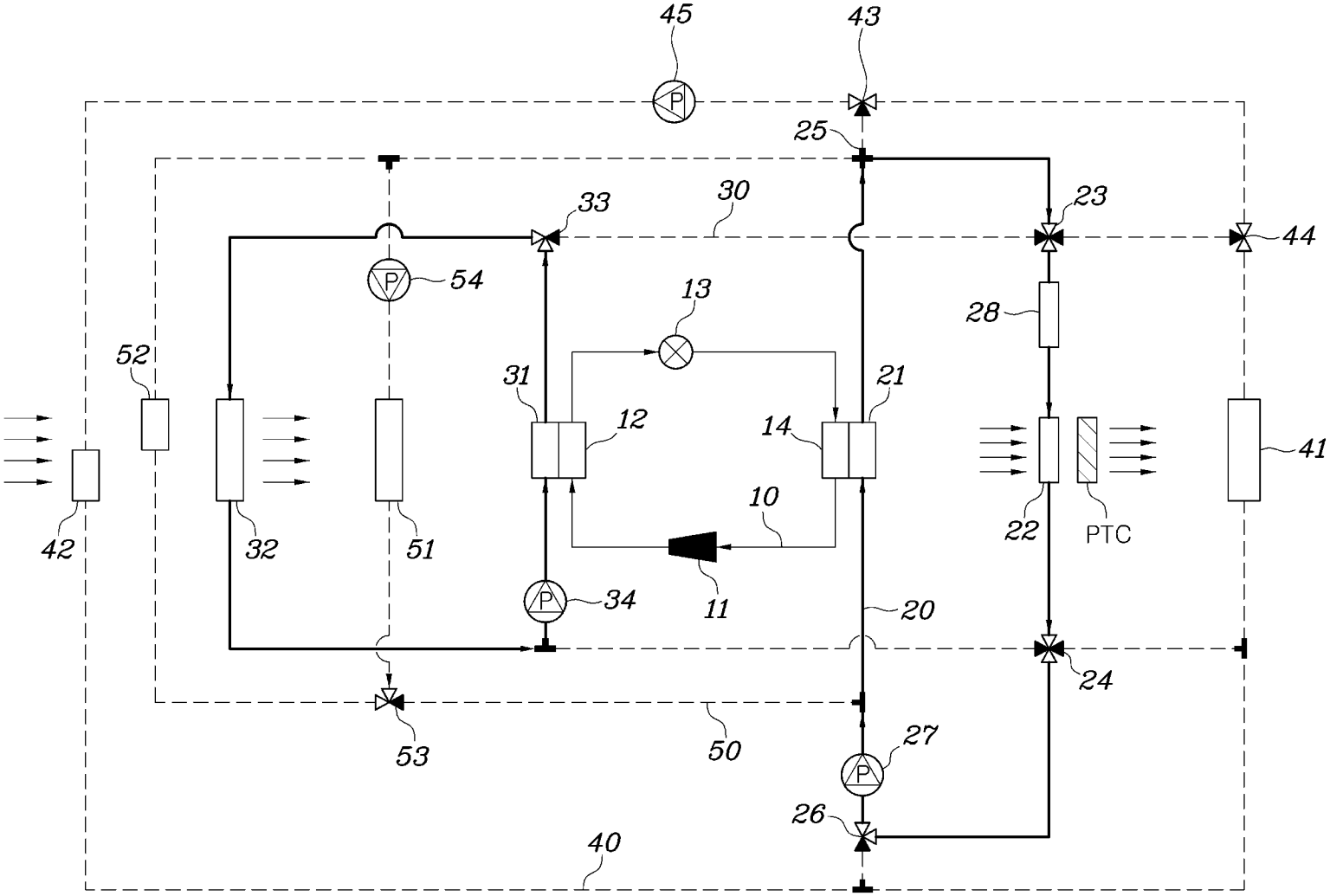
FIG. 12 is a view illustrating a dehumidification process during the process of heating the interior in the integrated thermal management system illustrated in FIG. 1.

Meanwhile, FIG. 3 is a view illustrating a process of cooling a PE component in the integrated thermal management system illustrated in FIG. 1, FIG. 4 is a view illustrating a process of cooling a battery in the integrated thermal management system illustrated in FIG. 1, FIG. 5 is a view illustrating a process of cooling an interior in the integrated thermal management system illustrated in FIG. 1, FIG. 6 is a view illustrating a process of cooling the PE component during the process of cooling the interior in the integrated thermal management system illustrated in FIG. 1, FIG. 7 is a view illustrating a process of cooling the battery during the process of cooling the interior in the integrated thermal management system illustrated in FIG. 1, FIG. 8 is a view illustrating a process of heating the interior in the integrated thermal management system illustrated in FIG. 1, FIG. 9 is a view illustrating a process of absorbing heat from the PE component during the process of heating the interior in the integrated thermal management system illustrated in FIG. 1, FIG. 10 is a view illustrating a process of absorbing heat from the battery during the process of heating the interior in the integrated thermal management system illustrated in FIG. 1, FIG. 11 is a view illustrating a process of raising a temperature of the battery in the integrated thermal management system illustrated in FIG. 1, and FIG. 12 is a view illustrating a dehumidification process during the process of heating the interior in the integrated thermal management system illustrated in FIG. 1.

As illustrated in FIGS. 1 and 2, the integrated thermal management system according to embodiments of the present invention includes a refrigerant circuit 10 including a compressor 11, a condenser 12, an expander 13, and an evaporator 14, a first coolant line 20 including a first heat exchanger 21 configured to exchange heat with the evaporator 14 of the refrigerant circuit 10, and an internal heat exchanger 22 configured to adjust a temperature of air-conditioning air by exchanging heat with a coolant, first and second switching valves 23 and 24 provided in the first coolant line and respectively disposed at front and rear ends of the internal heat exchanger 22, a second coolant line 30 connected to the first and second switching valves 23 and 24 and including a second heat exchanger 31 configured to exchange heat with the condenser 12 of the refrigerant circuit 10, a third coolant line 40 branching off from the first coolant line 20 and including a battery 41, and a fourth coolant line 50 branching off from the first coolant line 20 and including a PE component 51.

According to embodiments of the present invention, a temperature of the coolant is adjusted by heat exchange between a refrigerant circulating in the refrigerant circuit 10 and the coolant circulating in the first coolant line 20 and the second coolant line 30, and the cooled or heated coolant flows to the internal heat exchanger 22, such that cooling air or heating air is produced by heat exchange between the coolant and air.

In the related art, a cold core for cooling the interior and a heat core for heating the interior are disposed one by one. During the process of heating the interior, a separate PTC heater is provided, such that it is easy to ensure a heat source for heating. However, during the process of cooling the interior, sufficient heat exchange for cooling cannot be performed only by the cold core. Therefore, in case that an area of the cold core increases, there is a problem in that a size of a package increases, and it is difficult to ensure sufficient cooling performance only by increasing the area.

Therefore, according to an embodiment of the present invention, the refrigerant circuit 10, in which the refrigerant circulates, is provided, and the plurality of coolant lines, which exchanges heat with the refrigerant in the refrigerant circuit 10, is provided. Therefore, a cold or hot coolant, which is produced by heat exchange between the refrigerant and the coolant, is provided to the internal heat exchanger 22, such that air-conditioning air for cooling or air-conditioning air for heating is produced by the internal heat exchanger 22.

The coolant lines according to an embodiment of the present invention include the first coolant line 20, the second coolant line 30, the third coolant line 40, and the fourth coolant line 50.

In this case, the first coolant line 20 further includes a first water pump 27 and a coolant heater 28. The second coolant line 30 further includes a second water pump 34. The third coolant line 40 further includes a third water pump 45. The fourth coolant line 50 further includes a fourth water pump 54. That is, the water pumps are respectively provided in the coolant lines, such that the coolant is circulated in the respective coolant lines by operations of the respective water pumps.

In addition, the coolant heater 28 may be provided at a front end of the internal heat exchanger 22 in the first coolant line. The coolant heater 28 may be selectively operated to perform the heating process by the internal heat exchanger 22 or to raise the temperature of the battery 41, thereby raising the temperature of the coolant.

The first heat exchanger 21 and the internal heat exchanger 22 are provided in the first coolant line 20. The first heat exchanger 21 cools the coolant by exchanging heat with the evaporator 14 of the refrigerant circuit 10. The internal heat exchanger 22 is provided in an air-conditioning casing and exchanges heat with air provided in the interior. Therefore, when the coolant, which is cooled by the heat exchange between the coolant and the refrigerant in the first heat exchanger 21, flows to the internal heat exchanger 22, the air-conditioning air is cooled by the internal heat exchanger 22, such that the air-conditioning air for cooling may be provided to the interior.

In particular, the first and second switching valves 23 and 24 are respectively provided at the front and rear ends of the internal heat exchanger 22 in the first coolant line 20. The first and second switching valves 23 and 24 each have a plurality of ports, such that another coolant line may be connected to the first coolant line 20 by means of the first and second switching valves 23 and 24. Further, a heat pump and the cooling and heating processes by the internal heat exchanger 22 may be implemented by change flows of the coolant in the plurality of coolant lines.

That is, the second coolant line 30 is connected to the first and second switching valves 23 and 24 and includes the second heat exchanger 31 configured to exchange heat with the condenser 12 of the refrigerant circuit 10. Therefore, in case that the coolant, which is heated by the heat exchange between the coolant and the refrigerant in the second heat exchanger 31, flows to the internal heat exchanger 22 by an operation of opening or closing the first and second switching valves 23 and 24, the air-conditioning air is heated by the internal heat exchanger 22, such that the air-conditioning air for heating may be provided to the interior.

As described above, according to embodiments of the present invention, the coolant circulating in the first coolant line 20 or the coolant circulating in the second coolant line 30 selectively flows to the internal heat exchanger 22 by the control operation of opening or closing the first and second switching valves 23 and 24, which makes it possible to cool or heat the air-conditioning air by using the single internal heat exchanger 22.

Meanwhile, the third coolant line 40 includes the battery 41 and branches off from the first coolant line 20. The third coolant line 40 is connected to the first coolant line 20 so that flow directions of the coolant are changed depending on whether the first and second switching valves 23 and 24 are opened or closed. Therefore, the coolant, which circulates in the third coolant line 40, may be shared by the first coolant line 20 or the second coolant line 30 depending on the control operation of opening or closing the first and second switching valves 23 and 24, thereby adjusting the temperature of the coolant.

In addition, the fourth coolant line 50 includes the PE component 51 and branches off from the first coolant line 20. The fourth coolant line 50 is connected to the first coolant line 20 so that the flow directions of the coolant are changed depending on whether the first and second switching valves 23 and 24 are opened or closed. Therefore, the coolant, which circulates in the fourth coolant line 50, may be shared by the first coolant line 20 or the second coolant line 30 depending on the control operation of opening or closing the first and second switching valves 23 and 24, thereby adjusting the temperature of the coolant.

Therefore, according to embodiments of the present invention, the operation of opening or closing the first and second switching valves 23 and 24 is adjusted, such that the coolant, which circulates in the plurality of coolant lines, may be shared by the plurality of coolant lines or separately circulated in the plurality of coolant lines, which makes it possible to not only manage the temperatures of the battery 41 and the PE component 51 but also implement the heat pump.

Meanwhile, the first coolant line 20 may further include a branch tube 25 disposed between the first heat exchanger 21 and the first switching valve 23 and a third switching valve 26 disposed between the first heat exchanger 21 and the second switching valve 24.

As can be seen in FIG. 1, the branch tube 25 is provided in the first coolant line 20, such that the third coolant line 40 and the fourth coolant line 50 may be connected to the first coolant line 20 through the branch tube 25. The branch tube 25 may be disposed between a front end of the first heat exchanger 21 and the first switching valve 23, such that the flow of the coolant circulating in the respective coolant lines may be switched depending on whether the first switching valve 23 is opened or closed.

In addition, the third switching valve 26 is provided in the first coolant line 20. The third switching valve 26 is provided at a rear end of the first heat exchanger 21 and a rear end of the internal heat exchanger 22 in the first coolant line 20. The third coolant line 40 and the fourth coolant line 50 may be connected to the third switching valve 26. The coolant may selectively circulate through the battery 41 or the PE component 51 depending on whether the third switching valve 26 is opened or closed.

Meanwhile, the second coolant line 30 may further include a radiator 32 and a fourth switching valve 33 configured to allow the coolant to selectively flow to the radiator 32. Therefore, in the case of the coolant in the second coolant line 30, the coolant having passed through the second heat exchanger 31 may flow to the internal heat exchanger 22 or exchange heat with outside air through the radiator 32 depending on the operation of opening or closing the fourth switching valve 33.

Meanwhile, the third coolant line 40 may be connected to the branch tube 25 and the third switching valve 26 and further include a first external heat exchanger 42, a fifth switching valve 43 configured to allow the coolant to selectively flow to the first external heat exchanger 42, and a sixth switching valve 44 selectively connected to the first switching valve 23 at a front end of the battery 41.

The fifth switching valve 43 and the sixth switching valve 44 allow the coolant, which circulates through the battery 41, to selectively exchange heat with the first heat exchanger 21 or the first external heat exchanger 42. In addition, the sixth switching valve 44 may be selectively connected to the first switching valve 23, such that the sixth switching valve 44 may operate in conjunction with the first switching valve 23 to allow the coolant in the second coolant line 30 to selectively flow to the battery 41. Therefore, the coolant, which has exchanged heat with the refrigerant through the first heat exchanger 21, or the coolant, which has exchanged heat with the outside air through the first external heat exchanger 42, may be supplied to the battery 41 and cooled. Alternatively, the coolant, which has exchanged heat with the refrigerant through the second heat exchanger 31, may be supplied to the battery 41 and heated.

Meanwhile, the fourth coolant line 50 may be connected between the branch tube 25, the first heat exchanger 21, and the third switching valve 26 and may further include a second external heat exchanger 52 and a seventh switching valve 53 configured to allow the coolant to selectively flow to the second external heat exchanger 52. Therefore, in the case of the coolant in the fourth coolant line 50, the coolant having passed through the PE component 51 may be cooled by the first heat exchanger 21 or cooled by exchanging heat with the outside air through the second external heat exchanger 52 depending on the operation of opening or closing the seventh switching valve 53.

As described above, according to embodiments of the present invention, the coolant may be shared by the plurality of coolant lines or separately circulated by means of the branch tube 25 and the plurality of switching valves, which makes it possible to adjust the temperatures of the refrigerant and the coolant and implement the heat pump.

The first switching valve 23 may be a four-way valve and include a port connected to the branch tube 25, a port connected to the front end of the internal heat exchanger 22 in the first coolant line 20, a port connected to the rear end of the second heat exchanger 31 of the second coolant line 30, and a port connected to the front end of the battery 41 of the third coolant line 40.

In addition, the second switching valve 24 may be a four-way valve and include a port connected to the third switching valve 26 of the first coolant line 20, a port connected to the rear end of the internal heat exchanger 22 of the first coolant line 20, a port connected to the front end of the second heat exchanger 31 of the second coolant line 30, and a port connected to the rear end of the battery 41 of the third coolant line 40.

As described above, the plurality of coolant lines is connected to the first and second switching valves 23 and 24, and the flow directions of the coolant circulating in the respective coolant lines are changed depending on whether the first and second switching valves 23 and 24 are opened or closed. Therefore, it is possible to cool or heat the interior by using the single internal heat exchanger 22 and implement various functions such as the function of cooling the battery 41 and the PE component 51, the function of raising the temperature of the battery 41, the heat pump, and the like.

The integrated thermal management system according to embodiments of the present invention may implement various functions, which include the functions of cooling and heating the interior and the heat pump, by circulating the refrigerant and the coolant.

That is, the integrated thermal management system according to embodiments of the present invention further includes a controller 100 configured to control the compressor 11, the respective switching valves, and the respective water pumps in accordance with an air conditioning mode and a thermal management mode. The controller 100 may receive information on whether to cool or heat the interior, the temperature of the battery 41, the temperature of the PE component 51, and the like. The controller 100 controls the compressor 11, the respective switching valves, and the respective water pumps on the basis of whether to cool the interior, whether to heat the interior, whether to adjust the temperatures of the battery 41 and the PE component 51, and whether to adjust the temperatures of the refrigerant and the coolant.

Specifically, as illustrated in FIG. 3, at the time of cooling the PE component 51, the controller 100 may operate the fourth water pump 54 and control the respective switching valves so that the coolant flows to the PE component 51 and the second external heat exchanger 52 in the fourth coolant line 50.

That is, at the time of cooling the PE component 51 through the heat exchange with the outside air, the controller 100 controls the seventh switching valve 53 so that the coolant is circulated in the fourth coolant line 50 by the operation of the fourth water pump 54, and the coolant, which has cooled the PE component 51, flows to the second external heat exchanger 52. Therefore, the PE component 51 may be cooled as the coolant, which has exchanged heat with the outside air through the second external heat exchanger 52, circulates.

Meanwhile, at the time of cooling the battery 41, the controller 100 may operate the third water pump 45 and control the respective switching valves so that the coolant flows to the battery 41 and the first external heat exchanger 42 in the third coolant line 40.

That is, at the time of cooling the battery 41 through the heat exchange with the outside air, the controller 100 controls the third switching valve 26, the fifth switching valve 43, and the sixth switching valve 44 so that the coolant is circulated in the third coolant line 40 by the operation of the third water pump 45, and the coolant, which has cooled the battery 41, flows to the first external heat exchanger 42. Therefore, the battery 41 may be cooled as the coolant, which has exchanged heat with the outside air through the first external heat exchanger 42, circulates.

Meanwhile, as illustrated in FIG. 4, at the time of cooling the battery 41, the controller 100 may operate the compressor 11 to circulate the refrigerant in the refrigerant circuit 10, and the controller 100 may operate the first and second water pumps and control the respective switching valves so that the coolant flows to the first heat exchanger 21 and the battery 41 through the first coolant line 20 and the third coolant line 40, and the coolant flows to the second heat exchanger 31 and the radiator 32 in the second coolant line 30.

That is, at the time of cooling the battery 41 by circulating the refrigerant in the refrigerant circuit 10, the controller 100 operates the compressor 11 to circulate the refrigerant in the refrigerant circuit 10.

In addition, the coolant in the first coolant line 20 is circulated by the operation of the first water pump 27, and the controller 100 controls the first switching valve 23, the third switching valve 26, the fifth switching valve 43, and the sixth switching valve 44 so that the coolant, which has cooled the battery 41, circulates through the first heat exchanger 21. Therefore, the battery 41 may be cooled as the coolant, which has been cooled by exchanging heat with the refrigerant through the first heat exchanger 21, circulates.

In addition, the coolant in the second coolant line 30 is circulated by the operation of the second water pump 34, and the controller 100 controls the second switching valve 24 so that the coolant, which has exchanged heat with the second heat exchanger 31, circulates through the radiator 32. Therefore, the coolant cooled by the radiator 32 exchanges heat with the refrigerant through the second heat exchanger 31, such that the temperature of the refrigerant may be adjusted.

The control operations, which are performed depending on the adjustment of the temperatures of the battery 41 and the PE component 51, may be simultaneously or independently performed on the basis of the temperatures of the battery 41 and the PE component 51.

Meanwhile, as illustrated in FIG. 5, at the time of cooling the interior, the controller 100 may operate the compressor 11 to circulate the refrigerant in the refrigerant circuit 10, and the controller 100 may operate the first and second water pumps and control the respective switching valves so that the coolant flows to the first heat exchanger 21 and the internal heat exchanger 22 in the first coolant line 20 and the coolant flows to the second heat exchanger 31 and the radiator 32 in the second coolant line 30.

That is, at the time of cooling the interior, the controller 100 operates the compressor 11 to circulate the refrigerant in the refrigerant circuit 10.

In addition, the coolant in the first coolant line 20 is circulated by the operation of the first water pump 27, and the controller 100 controls the first switching valve 23, the second switching valve 24, the third switching valve 26, and the fifth switching valve 43 so that the coolant, which has been cooled by exchanging heat with the refrigerant through the first heat exchanger 21, circulates through the internal heat exchanger 22. Therefore, the internal heat exchanger 22 may exchange heat with the air, which is provided to the interior as the cold coolant flows, and the internal heat exchanger 22 may provide the air-conditioning air for cooling to the interior.

In addition, the coolant in the second coolant line 30 is circulated by the operation of the second water pump 34, and the controller 100 controls the second switching valve 24 so that the coolant, which has exchanged heat with the second heat exchanger 31, circulates through the radiator 32. Therefore, the coolant cooled by the radiator 32 exchanges heat with the refrigerant through the second heat exchanger 31, such that the temperature of the refrigerant may be adjusted.

Meanwhile, as illustrated in FIG. 6, at the time of cooling the PE component 51 during the process of cooling the interior, the controller 100 may operate the fourth water pump 54 and control the respective switching valves so that the coolant flows to the PE component 51 and the second external heat exchanger 52 in the fourth coolant line 50.

In addition, at the time of cooling the battery 41 during the process of cooling the interior, the controller 100 may operate the third water pump 45 and control the respective switching valves so that the coolant flows to the battery 41 and the first external heat exchanger 42 in the third coolant line 40.

That is, at the time of cooling the PE component 51 or the battery 41 by using the outside air during the process of cooling the interior, like the control operation related to the process of cooling the interior, the controller 100 operates the compressor 11 to allow the refrigerant to circulate in the refrigerant circuit 10, and the controller 100 controls the respective water pumps and the respective switching valves so that the coolant, which has been cooled by exchanging heat with the refrigerant through the first heat exchanger 21 in the first coolant line 20, circulates through the internal heat exchanger 22, and the refrigerant, which has exchanged heat through the second heat exchanger 31 in the second coolant line 30, circulates through the radiator 32. Therefore, the internal heat exchanger 22 may cool the air to be provided to the interior and provide the air-conditioning air for cooling to the interior, thereby managing the temperature of the refrigerant.

In this case, the coolant in the fourth coolant line 50 circulates through the PE component 51 and the second external heat exchanger 52, such that the PE component 51 may be cooled by the coolant that has exchanged heat with the outside air through the second external heat exchanger 52.

In addition, the coolant in the third coolant line 40 circulates through the battery 41 and the first external heat exchanger 42, such that the battery 41 may be cooled by the coolant that has exchanged heat with the outside air through the first external heat exchanger 42.

As described above, according to embodiments of the present invention, during the process of cooling the interior, the outside air may be used to not only manage the temperature of the refrigerant but also to cool the battery 41 and the PE component 51.

Meanwhile, as illustrated in FIG. 7, at the time of cooling the battery 41 during the process of cooling the interior, the controller 100 may control the respective switching valves so that the coolant flows to the first heat exchanger 21, the internal heat exchanger 22, and the battery 41 through the first coolant line 20 and the third coolant line 40 and the coolant flows to the second heat exchanger 31 and the radiator 32 in the second coolant line 30.

That is, at the time of cooling the battery 41 through the heat exchange with the refrigerant in the refrigerant circuit 10 during the process of cooling the interior, like the control operation related to the process of cooling the interior, the controller 100 operates the compressor 11 to allow the refrigerant to circulate in the refrigerant circuit 10, and the controller 100 controls the respective water pumps and the respective switching valves so that the coolant, which has been cooled by exchanging heat with the refrigerant through the first heat exchanger 21 in the first coolant line 20, circulates through the internal heat exchanger 22, and the refrigerant, which has exchanged heat through the second heat exchanger 31 in the second coolant line 30, circulates through the radiator 32. Therefore, the internal heat exchanger 22 may cool the air to be provided to the interior and provide the air-conditioning air for cooling to the interior, thereby managing the temperature of the refrigerant.

In addition, the controller 100 controls the third switching valve 26, the fifth switching valve 43, and the sixth switching valve 44 so that a part of the coolant, which has been cooled by exchanging heat with the refrigerant through the first heat exchanger 21, flows to the battery 41 and the battery 41 is also cooled.

Therefore, the processes of cooling the interior and the battery 41 may be simultaneously performed by using the cold coolant that has exchanged heat with the refrigerant in the refrigerant circuit 10 through the first heat exchanger 21.

An optimized method of controlling the process of cooling the PE component 51 and the battery 41 by using the outside air and the process of cooling the battery 41 by using the coolant, which has exchanged heat with the first heat exchanger 21, during the process of cooling the interior may be selected for each situation on the basis of the determination of the controller 100.

Meanwhile, as illustrated in FIG. 8, at the time of heating the interior, the controller 100 may operate the compressor 11 to circulate the refrigerant in the refrigerant circuit 10, and the controller 100 may operate the first, second, and third water pumps and control the respective switching valves so that the coolant flows to the first heat exchanger 21 and the first external heat exchanger 42 through the first coolant line 20 and the third coolant line 40 and the coolant flows to the second heat exchanger 31 and the internal heat exchanger 22 through the first coolant line 20 and the second coolant line 30.

That is, at the time of heating the interior, the controller 100 operates the compressor 11 to circulate the refrigerant in the refrigerant circuit 10.

In addition, the second water pump 34 is operated, and the controller 100 controls the first switching valve 23, the second switching valve 24, and the fourth switching valve 33 so that the coolant, which has been heated by exchanging heat with the refrigerant through the second heat exchanger 31, circulates through the internal heat exchanger 22. Therefore, the internal heat exchanger 22 may exchange heat with the air, which is provided to the interior as the hot coolant flows, and the internal heat exchanger 22 may provide the air-conditioning air for heating to the interior.

In addition, the first water pump 27 and the third water pump 45 are operated, and the controller 100 controls the third switching valve 26 and the fifth switching valve 43 so that the coolant, which has exchanged heat with the evaporator 14 in the first heat exchanger 21, circulates through the first external heat exchanger 42. Therefore, the coolant, which has absorbed heat through the first external heat exchanger 42, may exchange heat with the refrigerant through the first heat exchanger 21, such that the temperature of the refrigerant may be adjusted.

Meanwhile, as illustrated in FIG. 9, at the time of absorbing heat from the PE component 51 during the process of heating the interior, the controller 100 operates the compressor 11 to circulate the refrigerant in the refrigerant circuit 10, and the controller 100 operates the second and fourth water pumps and controls the respective switching valves so that the coolant flows to the first heat exchanger 21 and the PE component 51 through the first coolant line 20 and the fourth coolant line 50 and the coolant flows to the second heat exchanger 31 and the internal heat exchanger 22 through the first coolant line 20 and the second coolant line 30.

That is, at the time of performing the heat pump operation by using the coolant having the temperature raised by cooling the PE component 51 during the process of heating the interior, the controller 100 operates the compressor 11 to circulate the refrigerant in the refrigerant circuit 10, and the controller 100 operates the second water pump 34 and controls the first switching valve 23, the second switching valve 24, and the fourth switching valve 33 so that the coolant, which has exchanged heat with the refrigerant through the second heat exchanger 31, flows to the internal heat exchanger 22. Therefore, it is possible to provide the air-conditioning air for heating to the interior through the internal heat exchanger 22.

In this case, the controller 100 operates the fourth water pump 54 and controls the third switching valve 26, the fifth switching valve 43, and the seventh switching valve 53 so that the coolant in the fourth coolant line 50 circulates through the PE component 51 and the first heat exchanger 21. Therefore, the coolant, which has absorbed heat by cooling the PE component 51, may exchange heat with the refrigerant through the first heat exchanger 21, such that the temperature of the refrigerant may be adjusted.

Meanwhile, as illustrated in FIG. 10, at the time of absorbing heat from the battery 41 during the process of heating the interior, the controller 100 operates the compressor 11 to circulate the refrigerant in the refrigerant circuit 10, and the controller 100 operates the first and second water pumps and controls the respective switching valves so that the coolant flows to the first heat exchanger 21 and the battery 41 through the first coolant line 20 and the third coolant line 40 and the coolant flows to the second heat exchanger 31 and the internal heat exchanger 22 through the first coolant line 20 and the second coolant line 30.

That is, at the time of performing the heat pump operation by using the coolant having the temperature raised by cooling the battery 41 during the process of heating the interior, the controller 100 operates the compressor 11 to circulate the refrigerant in the refrigerant circuit 10, and the controller 100 operates the second water pump 34 and controls the first switching valve 23, the second switching valve 24, and the fourth switching valve 33 so that the coolant, which has exchanged heat with the refrigerant through the second heat exchanger 31, flows to the internal heat exchanger 22, thereby providing the air-conditioning air for heating to the interior through the internal heat exchanger 22.

In this case, the controller 100 operates the first water pump 27 and controls the third switching valve 26, the fifth switching valve 43, and the sixth switching valve 44 so that the coolant circulates through the battery 41 and the first heat exchanger 21 through the first coolant line 20 and the third coolant line 40. Therefore, the coolant, which has absorbed heat by cooling the battery 41, may exchange heat with the refrigerant through the first heat exchanger 21, such that the temperature of the refrigerant in the refrigerant circuit 10 may be adjusted.

As described above, according to embodiments of the present invention, the temperature of the refrigerant in the refrigerant circuit 10 may be adjusted by absorbing heat from the outside air during the process of heating the interior, or the temperature of the refrigerant in the refrigerant circuit 10 may be adjusted by absorbing heat generated in the PE component 51 and the battery 41. Therefore, it is possible to improve energy efficiency by efficiently managing the refrigerant and the coolant.

Meanwhile, as illustrated in FIG. 11, at the time of raising a temperature of the battery 41, the controller 100 operates the second water pump 34 and controls the respective switching valves so that the coolant flows to the internal heat exchanger 22, the second heat exchanger 31, and the battery 41 through the first coolant line 20, the second coolant line 30, and the third coolant line 40 and the coolant heater 28 operates.

That is, at the time of raising the temperature of the battery 41, the controller 100 operates the second water pump 34 and the coolant heater 28. In addition, the controller 100 allows the coolant to flow to the coolant heater 28, the internal heat exchanger 22, and the battery 41 through the first coolant line 20, the second coolant line 30, and the third coolant line 40, such that the coolant having the temperature raised by the coolant heater 28 may be supplied to the battery 41 and the temperature of the battery 41 may be raised.

In addition, when the temperature of the battery 41 is required to be raised, the process of heating the interior may also be performed because a temperature of outside air is low. Therefore, the controller 100 may heat the coolant through the second heat exchanger 31 by circulating the refrigerant in the refrigerant circuit 10, thereby supplementing the heat source that is insufficiently provided only by the coolant heater 28.

Meanwhile, as illustrated in FIG. 12, at the time of performing dehumidification during the process of heating the interior, the controller 100 may operate the compressor 11 to circulate the refrigerant in the refrigerant circuit 10, and the controller 100 may operate the first water pump 27 and control the respective switching valves so that the coolant flows to the first heat exchanger 21 and the internal heat exchanger 22 in the first coolant line 20 and a PTC operates.

In the air-conditioning casing, the PTC is provided to supplement the heat source for the air-conditioning air at the time of heating the interior.

At the time of simultaneously performing the process of heating the interior and the process of dehumidifying the interior, the controller 100 operates the compressor 11 to circulate the refrigerant in the refrigerant circuit 10, and the controller 100 operates the first water pump 27 and controls the first switching valve 23, the second switching valve 24, the third switching valve 26, and the fifth switching valve 43 so that the coolant flows to the first heat exchanger 21 and the internal heat exchanger 22 in the first coolant line 20. Therefore, the internal heat exchanger 22 dries the interior air by absorbing heat. At the same time, the controller 100 operates the PTC to heat the air-conditioning air to be provided to the interior, such that the air-conditioning air for heating with the raised temperature is provided to the interior.

At the same time, the controller 100 may control the respective water pumps and the respective switching valves so that the coolant in the second coolant line 30 circulates through the second heat exchanger 31 and the radiator 32 to adjust the temperature of the refrigerant in the refrigerant circuit 10 or the coolant circulates through the second heat exchanger 31 and the battery 41 through the first coolant line 20, the second coolant line 30, and the third coolant line 40 to raise the temperature of the battery 41 and adjust the temperature of the refrigerant.

As described above, according to embodiments of the present invention, the process of heating the interior and the process of dehumidifying the interior may be simultaneously implemented.

Meanwhile, the controller 100 may adjust the amount of operation of the compressor 11 or each of the water pumps on the basis of the temperature of the air-conditioning air or the temperature of the interior at the time of cooling or heating the interior.

For example, in case that an excessive amount of heat of the air-conditioning air is required to be provided to the interior during a process of rapidly cooling the interior or a process of rapidly heating the interior, the controller 100 maximizes the amount of operation of the compressor 11. Therefore, in the case of the process of cooling the interior, the amount of heat exchange between the evaporator 14 and the first heat exchanger 21 increases, such that the temperature of the coolant flowing to the internal heat exchanger 22 may be quickly lowered. In the case of the process of heating the interior, the amount of heat exchange between the condenser 12 and the second heat exchanger 31 increases, such that the temperature of the coolant flowing to the internal heat exchanger 22 may be quickly raised.

In addition, the amount of operation of each of the water pumps increases, such that the flow amount of the coolant may be increased and the heat exchange between the coolant and the air-conditioning air in the internal heat exchanger 22 may be accelerated.

As described above, when the temperature of the interior reaches a target temperature at the time of cooling or heating the interior, the amount of operation of the compressor 11 and each of the water pumps is slowly decreased to maintain the temperature of the interior.

According to the integrated thermal management system structured as described above, the refrigerant circulation module is miniaturized, such that the performance in cooling the interior is improved without increasing the size of the cold core at the time of conditioning air in the interior through the heat exchange between the refrigerant and the coolant.

That is, the cold coolant, which has exchanged heat with the evaporator 14 of the refrigerant circuit 10, or the hot coolant, which has exchanged heat with the condenser 12 of the refrigerant circuit 10, selectively flows to the internal heat exchanger 22 for cooling the interior, which makes it possible to adjust the temperature of the air-conditioning air and simplify the structure because the temperature of the air-conditioning air may be adjusted only by the single internal heat exchanger 22.

In addition, the temperatures of the battery 41 and the PE component 51 may be managed, and the heat pump may be implemented, thereby ensuring energy efficiency.

While the specific embodiments of the present invention have been illustrated and described, it will be obvious to those skilled in the art that embodiments of the present invention may be variously modified and changed without departing from the technical spirit of the present invention defined in the appended claims.

What is claimed is:

1. An integrated thermal management system comprising:

a refrigerant circuit comprising a compressor, a condenser, an expander, and an evaporator;

a first coolant line comprising a first heat exchanger configured to exchange heat with the evaporator of the refrigerant circuit and an internal heat exchanger configured to adjust a temperature of air-conditioning air through heat exchange with a coolant;

first and second switching valves respectively disposed at front and rear ends of the internal heat exchanger in the first coolant line;

a second coolant line connected to the first and second switching valves and comprising a second heat exchanger configured to exchange heat with the condenser of the refrigerant circuit, a radiator, and a fourth switching valve configured to allow the coolant to selectively flow to the radiator;

a third coolant line branching off from the first coolant line and comprising a battery; and a fourth coolant line branching off from the first coolant line and comprising a PE component, wherein the first coolant line further comprises a branch tube disposed between the first heat exchanger and the first switching valve, and a third switching valve disposed between the first heat exchanger and the second switching valve, wherein the third coolant line is connected to the branch tube and the third switching valve, and wherein the third coolant line further comprises a first external heat exchanger, a fifth switching valve configured to allow the coolant to selectively flow to the first external heat exchanger, and a sixth switching valve selectively connected to the first switching valve at a front end of the battery.

2. The integrated thermal management system of claim 1, wherein the fourth coolant line is connected between the branch tube, the first heat exchanger, and the third switching valve, and wherein the fourth coolant line further comprises:

a second external heat exchanger, and a seventh switching valve configured to allow the coolant to selectively flow to the second external heat exchanger.

3. The integrated thermal management system of claim 2, wherein the second switching valve comprises a four-way valve and has a first port connected to the third switching valve of the first coolant line, a second port connected to the rear end of the internal heat exchanger of the first coolant line, a third port connected to a front end of the second heat exchanger of the second coolant line, and a fourth port connected to a rear end of the battery of the third coolant line.

4. An integrated thermal management system comprising:

a refrigerant circuit comprising a compressor, a condenser, an expander, and an evaporator;

a first coolant line comprising:

a first heat exchanger configured to exchange heat with the evaporator of the refrigerant circuit;

an internal heat exchanger configured to adjust a temperature of air-conditioning air through heat exchange with a coolant;

a branch tube disposed between the first heat exchanger and a first switching valve;

a third switching valve disposed between the first heat exchanger and a second switching valve;

a first water pump; and a coolant heater;

the first and second switching valves respectively disposed at front and rear ends of the internal heat exchanger in the first coolant line;

a second coolant line connected to the first and second switching valves and comprising:

a second heat exchanger configured to exchange heat with the condenser of the refrigerant circuit;

a radiator;

a fourth switching valve configured to allow the coolant to selectively flow to the radiator; and a second water pump;

a third coolant line branching off from the first coolant line and connected to the branch tube and the third switching valve, the third coolant line comprising:

a battery;

a first external heat exchanger;

a fifth switching valve configured to allow the coolant to selectively flow to the first external heat exchanger;

a sixth switching valve selectively connected to the first switching valve at a front end of the battery; and a third water pump; and a fourth coolant line branching off from the first coolant line and connected between the branch tube, the first heat exchanger, and the third switching valve, the fourth coolant line comprising:

a PE component;

a second external heat exchanger;

a seventh switching valve configured to allow the coolant to selectively flow to the second external heat exchanger; and a fourth water pump.

5. The integrated thermal management system of claim 4, further comprising a controller configured to control the compressor, the respective switching valves, and the respective water pumps in accordance with an air conditioning mode and a thermal management mode.

6. The integrated thermal management system of claim 5, wherein at a time of cooling the PE component, the controller is configured to operate the fourth water pump and control the respective switching valves so that the coolant flows to the PE component and the second external heat exchanger in the fourth coolant line.

7. The integrated thermal management system of claim 5, wherein at a time of cooling the battery, the controller is configured to operate the third water pump and control the respective switching valves so that the coolant flows to the battery and the first external heat exchanger in the third coolant line.

8. The integrated thermal management system of claim 5, wherein at a time of cooling the battery, the controller is configured to operate the compressor to circulate a refrigerant in the refrigerant circuit and to operate the first and second water pumps and control the respective switching valves so that the coolant flows to the first heat exchanger and the battery through the first coolant line and the third coolant line and the coolant flows to the second heat exchanger and the radiator in the second coolant line.

9. The integrated thermal management system of claim 5, wherein at a time of cooling an interior, the controller is configured to operate the compressor to circulate a refrigerant in the refrigerant circuit and to operate the first and second water pumps and control the respective switching valves so that the coolant flows to the first heat exchanger and the internal heat exchanger in the first coolant line and the coolant flows to the second heat exchanger and the radiator in the second coolant line.

10. The integrated thermal management system of claim 9, wherein at a time of cooling the PE component at the time of cooling the interior, the controller is configured to operate the fourth water pump and control the respective switching valves so that the coolant flows to the PE component and the second external heat exchanger in the fourth coolant line.

11. The integrated thermal management system of claim 9, wherein at a time of cooling the battery at the time of cooling the interior, the controller is configured to operate the third water pump and control the respective switching valves so that the coolant flows to the battery and the first external heat exchanger in the third coolant line.

12. The integrated thermal management system of claim 9, wherein at a time of cooling the battery at the time of cooling the interior, the controller is configured to control the respective switching valves so that the coolant flows to the first heat exchanger, the internal heat exchanger, and the battery through the first coolant line and the third coolant line and the coolant flows to the second heat exchanger and the radiator in the second coolant line.

13. The integrated thermal management system of claim 5, wherein at a time of heating an interior, the controller is configured to operate the compressor to circulate a refrigerant in the refrigerant circuit and to operate the first, second, and third water pumps and control the respective switching valves so that the coolant flows to the first heat exchanger and the first external heat exchanger through the first coolant line and the third coolant line and the coolant flows to the second heat exchanger and the internal heat exchanger through the first coolant line and the second coolant line.

14. The integrated thermal management system of claim 5, wherein at a time of absorbing heat from the PE component during a process of heating an interior, the controller is configured to operate the compressor to circulate a refrigerant in the refrigerant circuit and to operate the second and fourth water pumps and control the respective switching valves so that the coolant flows to the first heat exchanger and the PE component through the first coolant line and the fourth coolant line and the coolant flows to the second heat exchanger and the internal heat exchanger through the first coolant line and the second coolant line.

15. The integrated thermal management system of claim 5, wherein at a time of absorbing heat from the battery during a process of heating an interior, the controller is configured to operate the compressor to circulate a refrigerant in the refrigerant circuit and to operate the first and second water pumps and control the respective switching valves so that the coolant flows to the first heat exchanger and the battery through the first coolant line and the third coolant line and the coolant flows to the second heat exchanger and the internal heat exchanger through the first coolant line and the second coolant line.

16. The integrated thermal management system of claim 5, wherein at a time of raising a temperature of the battery, the controller is configured to operate the second water pump and control the respective switching valves so that the coolant flows to the internal heat exchanger, the second heat exchanger, and the battery through the first coolant line, the second coolant line, and the third coolant line and the coolant heater operates.

17. The integrated thermal management system of claim 5, further comprising a PTC configured to adjust a temperature of the air-conditioning air together with the internal heat exchanger, wherein at a time of performing dehumidification during a process of heating an interior, the controller is configured to operate the compressor to circulate a refrigerant in the refrigerant circuit and to operate the first water pump and control the respective switching valves so that the coolant flows to the first heat exchanger and the internal heat exchanger in the first coolant line and the PTC operates.

18. The integrated thermal management system of claim 5, wherein at a time of cooling or heating an interior, the controller is configured to adjust an amount of operation of the compressor or each of the water pumps based on a temperature of the air-conditioning air or a temperature of the interior.

19. The integrated thermal management system of claim 2, wherein the second switching valve comprises a four-way valve and has a first port connected to the third switching valve of the first coolant line, a second port connected to the rear end of the internal heat exchanger of the first coolant line, a third port connected to a front end of the second heat exchanger of the second coolant line, and a fourth port connected to a rear end of the battery of the third coolant line.

20. The integrated thermal management system of claim 1, wherein the first switching valve comprises a four-way valve and has a first port connected to the branch tube, a second port connected to a front end of the internal heat exchanger of the first coolant line, a third port connected to a rear end of the second heat exchanger of the second coolant line, and a fourth port connected to the front end of the battery of the third coolant line.

* * * * *